US009447653B1

(12) United States Patent
Abi Aad

(10) Patent No.: US 9,447,653 B1
(45) Date of Patent: Sep. 20, 2016

(54) INFLATABLE PACKER

(71) Applicant: Elie Robert Abi Aad, Jounieh (LB)

(72) Inventor: Elie Robert Abi Aad, Jounieh (LB)

( * ) Notice: Subject to any disclaimer, the term of this patent is extended or adjusted under 35 U.S.C. 154(b) by 0 days.

(21) Appl. No.: 14/714,272

(22) Filed: May 16, 2015

Related U.S. Application Data

(60) Provisional application No. 61/953,915, filed on Mar. 16, 2014.

(51) Int. Cl.
*E21B 33/12* (2006.01)
*E21B 33/127* (2006.01)

(52) U.S. Cl.
CPC ..... *E21B 33/127* (2013.01)

(58) Field of Classification Search
USPC ..... 166/179, 120, 128, 129, 130, 182, 183, 166/184, 187
See application file for complete search history.

(56) References Cited

U.S. PATENT DOCUMENTS

| | | | | |
|---|---|---|---|---|
| 2,228,241 | A * | 1/1941 | Baker et al. | 166/120 |
| 4,402,469 | A * | 9/1983 | Stiner | 242/245 |
| 6,220,920 | B1 * | 4/2001 | Baier | 446/250 |
| 7,552,777 | B2 | 6/2009 | Murray et al. | |
| 8,074,723 | B2 | 12/2011 | Nutley et al. | |
| 8,167,032 | B2 | 5/2012 | Lumbye et al. | |
| 8,397,802 | B2 | 3/2013 | Lembcke | |
| 8,561,689 | B2 | 10/2013 | Nutley et al. | |
| 8,627,894 | B2 | 1/2014 | Nutley et al. | |
| 2005/0092485 | A1 | 5/2005 | Brezinski et al. | |

* cited by examiner

*Primary Examiner* — David Andrews
*Assistant Examiner* — Ronald Runyan
(74) *Attorney, Agent, or Firm* — Harrison Law Office, PC.

(57) ABSTRACT

A permanent inflatable packer enabling wellbore isolation in both open hole and cased hole wells expands multiple times its original diameter to conform to borehole irregularities and eccentricities. Cement, water based mud or oil based mud activation fluid under prerequisite fluid pressure causes retainer to slide upon a mandrel causing fracture of shearing screws and compression of Belleville metal ring washers to enable activation fluid to flow around an O-ring and into a recess area to effectuate inflation of ribs sandwiched between rubber layers.

11 Claims, 4 Drawing Sheets

INFLATABLE PACKER

RELATED APPLICATIONS

This application claims priority based upon U.S. Provisional Application Ser. No. 61/953,915 filed Mar. 16, 2014.

FIELD OF THE INVENTION

The present invention relates to downhole production of hydrocarbons, and more particularly relates to inflatable production packers capable of becoming extremely expanded for enabling wellbore isolation for cementing stage and for facilitating production of hydrocarbons in multi-zone downhole operations and for enabling wellbore isolation for facilitating fracking operations.

BACKGROUND

There has been significant growth and developments in domestic applications of fracking during well completion operations. Special downwell equipment and downhole tools have been introduced to support and promote multi-zone production and during fracking operations, but a problem that has persisted is having the capability to successfully isolate multiple production zones using appropriate packers but without inhibiting normal fluid flow downhole. For example, industry standard inflatable packers have limited capability for achieving expansion of an implicated rubber element without unduly increasing packer outside diameter. It would be particularly advantageous in the downhole art to provide inflatable packers that effectuate prerequisite expansion to sufficiently isolate production zones to prevent hydrocarbons flow from one zone or stage to another.

Regardless of whether particular zones are producing or not, it is well known to be counterproductive for hydrocarbons to flow downhole or uphole from one zone into another, rather than to just flow uphole or even downhole. It will be understood by those skilled in the art that such zones or stages are purposefully separated from each other by properly emplacing packers or via such control tools as an inflow control devices to avoid interference with intended flow of hydrocarbons. That is, as is well known in the downhole art, there should be no communication between different zones.

Accordingly, what is needed is a permanent production inflatable packer that precludes interference from different hydrocarbon producing zones, on the basis of inherently having a smaller outer diameter than such production packers known in the art. It will be appreciated that such smaller diameter production packer prevents occurrence of damage thereto while being moved into place downhole. For instance, prior art packers tend to become stuck to virtually any of a plethora of wellbore obstructions which is especially troublesome under circumstances in which well clearance could be tight between the packer's outside diameter and the adjacent wellbore wall.

As will be elucidated hereinafter, once an embodiment of the instant inflatable permanent production packer is installed downhole typically avoiding well wall contact because of its significantly smaller outside diameter and simultaneously having minimized the chance of getting stuck while being emplaced and set within the wellbore, the rubber members swell to a greater extent than has heretofore been achieved in the art, and thereby precludes and blocks any uphole flow of hydrocarbons from a lower reservoir uphole and subsequently into an upper reservoir. Instead, flow of hydrocarbons proceeds within the inflatable packer tool, not within the annulus between the tool and the wellbore. Hence, it will be seen that embodiments of the present invention fulfill a crucial production packer prerequisite by facilitating proper placement downhole and then, once being properly emplaced, precluding interference between production zones. That is, unlike inflatable packers common in the art, embodiments hereof would be unlikely to be prematurely set downhole because of a dual activation fluid pressure threshold, thereby avoiding the necessity of fishing out the tool and possibly consequently causing damage thereto and, indeed, to other nearby tools that have been emplaced downhole.

These and other known deficiencies in the downhole art have continued to limit the functionality of commonly used packer tools. Accordingly, these limitations and disadvantages of the prior art are overcome with the present invention, wherein improved means and techniques are provided which are especially useful for effectively isolating production zones.

SUMMARY

Embodiments of the present inflatable packer tool pertain to zonal isolation permanent packers that afford more substantial expansion than has been heretofore known in the art. It will be appreciated by those conversant in the art that inflatable packers taught herein enable wellbore isolation in both open hole and cased hole, not only in vertical wells but also in horizontal wells, wherein practitioners can now permanently separate different well production zones and thereby control production logistics in a manner heretofore unattainable.

It will be seen that preferred embodiment of the present invention affords the unique capability of expanding multiple times its original diameter to effectively conform to borehole irregularities and eccentricities. Indeed, it will be appreciated that embodiments hereof afford expansion heretofore unattainable by prior art permanent packers applicable in open-hole for horizontal and vertical wells and in a cased-hole for horizontal wells. Furthermore, it will be seen that, once slips are installed, embodiments of the instant inflatable packer may also be installed in cased vertical wells. When equipped with slips, i.e., with hardened tool steel teeth for being slightly embedded into the casing, threaded sliding metal parts facilitate biting into casing and thereby preventing slipping of downhole tools when installed vertically in cased holes, embodiments of the present inflatable packer may be used in vertical cased holes. But, if no slips are installed, embodiments hereof may be used in all open hole wells and horizontal cased-hole wells, but not in vertical cased-hole wells.

It will be understood that inflatable packer embodiments taught hereunder inherently provide total contact with the formation once the packer sets. Moreover, unlike similar downhole tools known in the art, embodiments hereof set in a single downhole trip and may be rotated while being emplaced downhole. While the preferred activation fluid is cement because it affords a strong, reliable seal, other fluids may be used such as oil or water, or water or oil based mud.

It will also be seen that embodiments hereof comprise either discontinuous rib members or a continuous rib member that supports the rubber seal and provides increased strength. It has also been found that preferred embodiments afford consistent and reliable isolation of production zones even under exigent circumstances typified by extreme force engendered during fracking operations.

It should be understood that rubber members disclosed herein correspond to any of several suitable synthetic elastomeric polymeric materials known in the art, that afford high swell coefficient that enables production zones to be effectively isolated as contemplated hereunder. The terms "rubber"; synthetic rubber'; "elastomer"; and "elastomeric material" are used interchangeably herein. Such selected elastomer is cured in a manner well known in the art and then incorporated into embodiments of the present invention.

It is accordingly an object of the present invention to provide an inflatable packer that reduces operating costs by precluding the necessity for conventional cementing.

It is an object of the present invention to provide an inflatable packer that affords simple deployment.

It is another object of the present invention to provide an inflatable packer with prerequisite integrity and reliability to preclude vulnerability to either mechanical failure, hydraulic failure, or electrical failure.

It is also an object and advantage of the present invention that embodiments may rely upon virtually any activation fluid, such as oil, water or an admixture thereof, although cement is preferable.

These and other objects of the present invention will become apparent from the following specifications and accompanying drawings.

DETAILED DESCRIPTION

Figure 1:
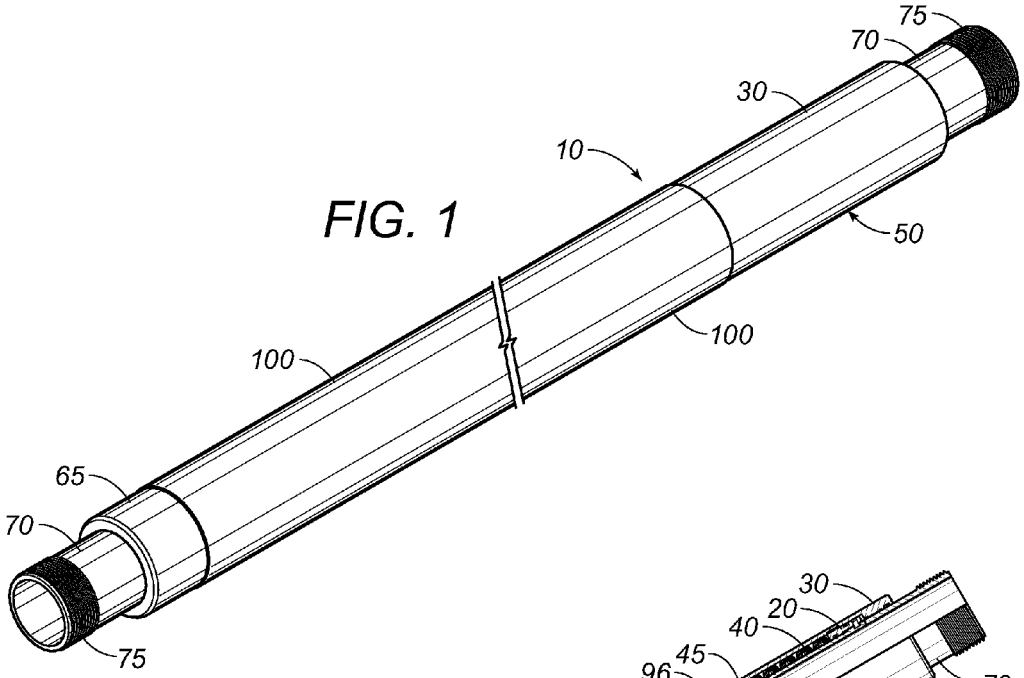
FIG. 1 depicts a frontal perspective view of an inflatable packer embodying the present invention.
Figure 2:
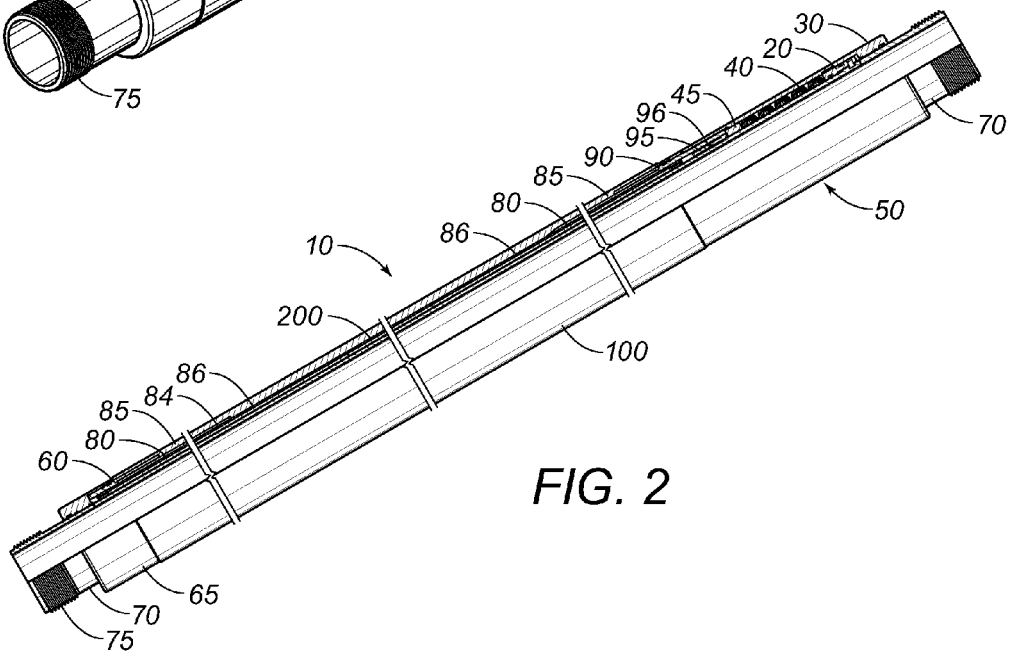
FIG. 2 depicts a frontal cross-sectional cut-away view of the inflatable packer embodiment depicted in FIG. 1.

Reference is made herein to the figures in the accompanying drawings in which like numerals refer to like components. Now referring collectively to FIGS. 1-7, there is depicted a preferred embodiment of the present invention corresponding to an inflatable packer as will be hereinafter described. More particularly, FIG. 1 depicts a frontal perspective view of an inflatable packer embodiment 10 taught by the present invention that would be emplaced downhole in the production string during a cementing stage or a hydrocarbons completion stage or during reservoir stimulation and enhancement. As shown in FIGS. 1-2 and 3A-3B, this preferred embodiment comprises axially disposed mandrel 70 having plurality of transverse channels 72 cut through the wall thereof for fluid communication from the wellbore (not shown) into the activation assembly 50 as will be hereinafter described, and with customer-specified thread 75 for adjoining mandrel 70 with another tubular or downhole tool. For example, customer-specified thread 75 might have a diameter or size of 5½" while the tool has an outer diameter of 7"; or alternatively, for the same thread size, have an outer diameter of 8" or 9". Mandrel 70 is circumscribed by a plurality of interrelated components which are configured to achieve the unique panoply of inflatable packer functionality as will be hereinafter described.

Thus, preferred embodiment 10 comprises activation assembly 50 which triggers severalfold inflation of the instant inflatable packer in a manner heretofore unknown in the art. More particularly, there are shown two O-rings 55 and 56, respectively, adjacent retainer member 20 and metal sealing sleeve member 30, in turn, disposed adjacent plurality of Belleville washer ring members 40 which behave in a compression spring-like manner as will become evident to those skilled in the art. Sealing sleeve member 30 is preferably threadedly affixed to mandrel 70 with suitably sized and dimensioned plurality of shearing screws 150. For example, such a thread might have a length of 5½" and an outer diameter of 7"; or alternatively, for the same length have an outer diameter of 8" or 9". As the only moving component in the instant preferred embodiment, it will become evident that retainer member 20 is urged by high-pressure activation fluid impressed upon vertical edge 25 thereof, to slide upon mandrel 70 in a prescribed direction linearly toward the plurality of Belleville washer metal ring members 40 causing compression thereof. It will be seen that O-ring 55 is disposed upon outside diameter of retainer member 20 for sealing against the surface 35 of inside diameter of sealing sleeve member 30 and similarly O-ring 56 is disposed upon inside diameter of retainer member 20 for sealing against mandrel 70. Enclosed within retainer 20 is at least one shearing screw 150 which is an integral component of the premature-activation prevention aspect of the activation assembly 50 contemplated by the present invention.

Referring collectively to FIGS. 1-7, compensator 45 comprises a full disk configuration and is disposed between plurality of Belleville metal washer members 40 and lock-in-place ring 95 and associated lock-in-pace pin 96. Lock-ring housing 90 encloses or houses these locking components at one end of activation assembly 50 and rib housing 60 encloses plurality of metal rib members 80 at the opposite end of the activation assembly. Enlargement nipple ring 130 is adjacent end portion 92 of metal sleeve member 30 and lock-ring housing 90. It should be understood that the pressure distribution varies in a manner functionally related to the compensator width. For instance, for a wider compensator, there would preferably be correspondingly fewer metal washer members and less pressure to be distributed. On the other hand, for a narrower compensator, there would preferably be correspondingly more metal washer members and higher pressure to be distributed.

It will become evident to those skilled in the art that the activation assembly contemplated herein comprises plurality of metal compression spring-like disks devolving preferably to Belleville metal ring washer members 40 which, due to prescribed compression-expansion characteristics, perform akin to springs. As is known in the art, such a spring-like configuration should preferably comprise a plurality of parallel Belleville metal ring washer members. Each such ring washer member is urged to form an essentially parallel planar configuration when compressed from its essentially convex, uncompressed configuration. As will be herein elucidated, when sufficient pressure is applied laterally to this series of parallel metal ring members within a prescribed pressure range, the spring-like behavior thereof is orchestrated. It should be understood that Belleville ring washers initially tend to naturally expand and this tendency initially prevents activation fluid from entering the activation assembly taught herein. Accordingly, an important fail-safe aspect of the preferred embodiment is that besides the activation fluid pressure threshold prerequisite for rupturing the shearing screws and enabling sliding movement of the retainer member toward the plurality of Belleville ring washer members, an even higher activation fluid pressure threshold is prerequisite for impressing the retainer against these Belleville ring washer members, causing compression thereof.

More particularly, it will be seen that, when sufficient fluid pressure is impressed upon embodiments of the instant inflatable packer, a suitably sized and dimensioned plurality of shearing screws 150 is caused to rupture by shearing forces, and then, with forced entry of activation fluid thereinto, when sufficient activation fluid pressure is imposed upon the series of metal ring washer members 40, these washer ring members are caused to become compressed. This compression, in turn, causes retainer member 20 to slide from its initial position wherein O-ring 55 becomes sealed against metal sleeve member 30 at the vertical surface thereof 35. This sliding movement of retainer member 20 and simultaneous movement of O-ring 55 fixedly disposed upon external surface thereof enables O-ring 55 to become close to the adjacent recess area 58, whereupon this O-ring ceases sealing against metal sleeve member 30. Consequently, O-ring 55 is no longer manifesting a seal between the outside diameter of retainer member 20 and the surface of inside diameter 35 of metal sealing sleeve member 30. Accordingly, borehole fluid can bypass or flow around displaced O-ring 55 and then flow into the recess area 58. It should be noted that, when retainer member 20 is caused to slidably move back to its initial position—O-ring 55 simultaneously moving therewith, O-ring 55 is again preferably emplaced upon the outer diameter of retainer member 20, thereby sealing it against inside surface 35 of metal sealing sleeve member 30.

As will be understood by those skilled in the art, if this internal activation fluid pressure exceeds predetermined limits, Belleville metal ring members 40 will be unable to be decompressed when this activation fluid pressure is attenuated and, consequently, embodiments of the inflatable packer contemplated hereunder will no longer be capable of containing the activation fluid which is effectuating inflation of the instant packer 10. For example, assuming that an embodiment of the instant inflatable packer is constructed with a 5½ inch outer diameter, the implicated limit would be 7,000 psi, functionally related to the number of washer ring members and the size of the compensator member incorporated into a particular embodiment hereof. It should be evident to practitioners in the art that differently-sized embodiments hereof will have different pressure limits.

Another aspect of embodiments hereof is a multi-dimensional internal locking mechanism that essentially locks in a zero degrees-of-freedom condition. That is, as elucidated herein, this unique multi-faceted locking infrastructure assures that neither linear translation nor rotational movement will occur while the preferred embodiment hereof is positioned in situ downhole. Lock-ring housing 90 disposed circumferentially of mandrel 70 encloses lock-in-place ring member 95 which, in turn, encloses plurality of lock-in-place pin members 96. It will be appreciated that lock-in-place ring member 95 is preferably not configured as a full disk but encompasses about 325°-359° in order to facilitate its emplacement about mandrel 70 before being affixed thereto with its teeth-like profile that tends to bite into the exterior surface of mandrel 70. Plurality of lock-in-place pin members 96 are then insertably affixed to the mandrel 70 to prevent any rotational movement thereof. It will also be clear that threads mated to the lock-ring housing 90 prevent any translation movement thereof.

Figure 3A:
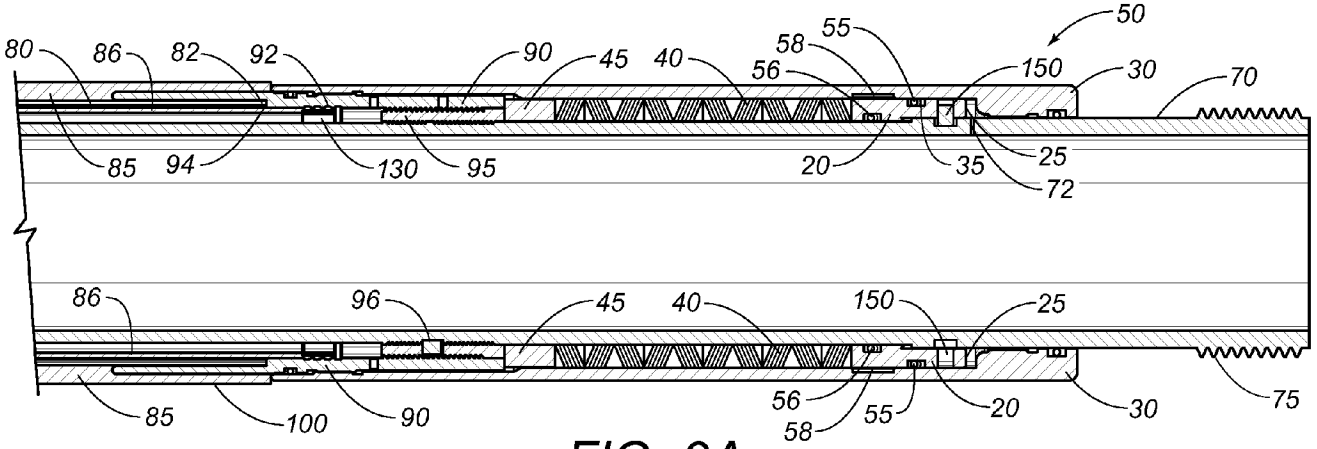
FIG. 3A depicts a frontal cross-sectional cut-away view of the pre-activation system embodying the present invention.

Referring now to FIG. 3A, in the pre-activation phase of the instant invention, each of plurality of Belleville washer metal ring members 40 is initially naturally configured in a convex arrangement and, when compressed by prerequisite pressure imposed by activation fluid, prevents wellbore fluid from entering the activation assembly 50 as will be herein described. It will be appreciated that, prior to activation, this activation assembly 50 is internally disposed in a closed condition wherein fluid is precluded from entering until the predetermined activation pressure is achieved. Being designed with a unique double-safety, i.e., a fail-safe, premature-activation preventive aspect, preferred embodiments inherently prohibit fluid from triggering inflation even if the screws constituting plurality of shearing screws 150 are inadvertently sheared, unless and until the predetermined pressure is reached. That is, activation assembly 50 is actually activated if and only if the designated prerequisite pressure is manifest. Otherwise, activation is prevented and, indeed, no premature activation occurs.

It should be understood that, in the pre-activation phase of the instant invention, when the predetermined prerequisite pressure is reached to effectuate sufficient compression of the plurality of Bellville metal washer ring members 40, the activation assembly infrastructure has become internally disposed in an open condition so that selected activation fluid, e.g., cement, enters thereinto, thereby triggering inflation. It will be seen that such entry of activation fluid causes retainer member 20 to slidably shift toward the series of metal washer ring members 40 and manifesting an open position under which these metal ring washer members 40 become fully compressed into a planar condition.

Accordingly, O-ring 55 disposed on the outside diameter of the retainer 20 will cease sealing against vertical edge 35 of sealing sleeve 30. It will be appreciated that this is attributable to the O-ring 55 being temporarily displaced from the sealing sleeve 30, thereby enabling activation fluid to flow around the O-ring 55 and then proceed by flowing to the recess surface 58 between the sealing sleeve 30 and the mandrel 70. Accordingly, it will be seen that activation fluid accumulates and tends to inflate the cured rubber member 100, thereby causing the preferably plurality of rubber-sleeve-sandwiched metal rib members 80 to be deformed irreversibly. It will be understood that, once the instant packer has become fully inflated, implicated pressure should be released as a prerequisite for the Belleville metal washer ring members 40 to be decompressed and return to their natural convex configuration to simultaneously urge the retainer member 20 back into its initial position relative to the metal ring spring-like members, thereby closing the activation assembly 50 and consequently entrapping the activation fluid that has entered the instant inflatable packer embodiment.

It will be seen that included on mandrel 70 is at least one channel 72 that functions as a communication port. Plurality of such channels should preferably be concentric and co-planar to promote efficient linear inward flow. It has been found that the size and configuration of these fluid channels communicating activation fluid into the activation assembly 50 of the present invention are essentially of no consequence so long as there is adequate entry of activation fluid thereinto. It will be appreciated by those skilled in the art that invoking a cup tool to transfer activation fluid pressure into the activation assembly 50 via channels 72 generally suffices to engender the prerequisite pressure contemplated hereunder.

At onset of the activation phase taught herein, when predetermined activation fluid enters activation assembly 50 of the instant embodiment, fluid pressure is imposed against the retainer 20. This pressure urges the retainer 20 to move leftward by sliding toward plurality of spring-like members 40, but resistance is encountered because of at least one shearing screw 150 being affixed to the mandrel 70. Nevertheless, once sufficient activation fluid pressure is effectuated to shear such screws 150, the retainer member 20 is no longer inhibited from moving toward the metal washer ring members 40 and, consequently, the retainer member is enabled to urge the series of spring-like members 40 to become compressed. It should be understood that this contemplated additional pressure is prerequisite for causing spring-compression of the Belleville metal washer ring members 40 or the like in order to be manifest as a series of planar, parallel structures. It will be appreciated that, once the shearing screws 150 have been sheared, the safety aspect thereof has been completed and, accordingly, cannot be reversed.

It has been found that the spring-like functionality prerequisite for preferred embodiments hereof, e.g., imparted by Belleville metal washer ring members, may alternatively be achieved by actually using properly configured and sized springs such as compression springs generally used in automobile suspensions and the like, and also by using swellable rubber wherein the activation fluid will cause the rubber to swell and accordingly seal and entrap fluids located inside.

Figure 3B:
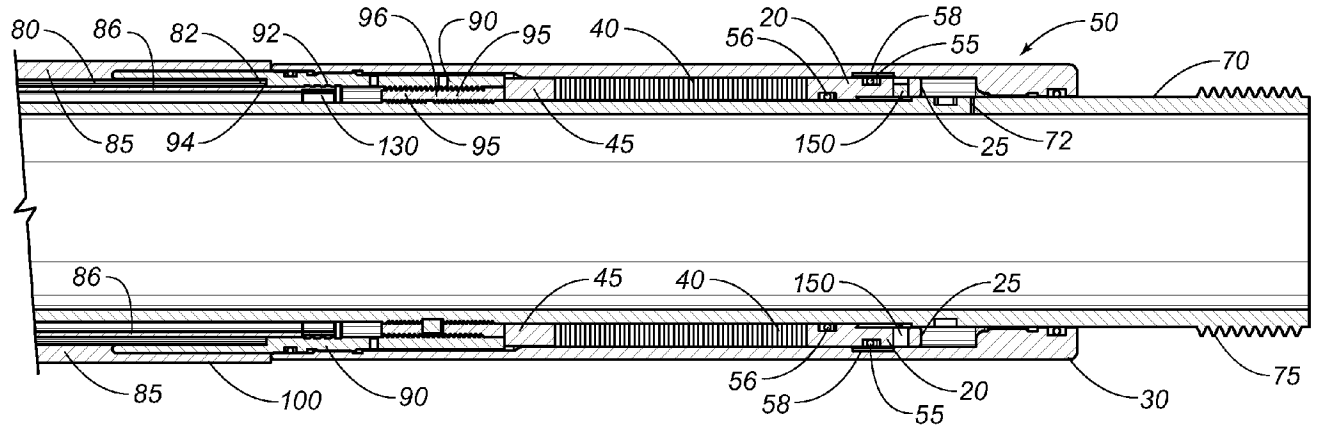
FIG. 3B depicts a frontal cross-sectional cut-away view of the post-activation system embodying the present invention.
Figure 4:
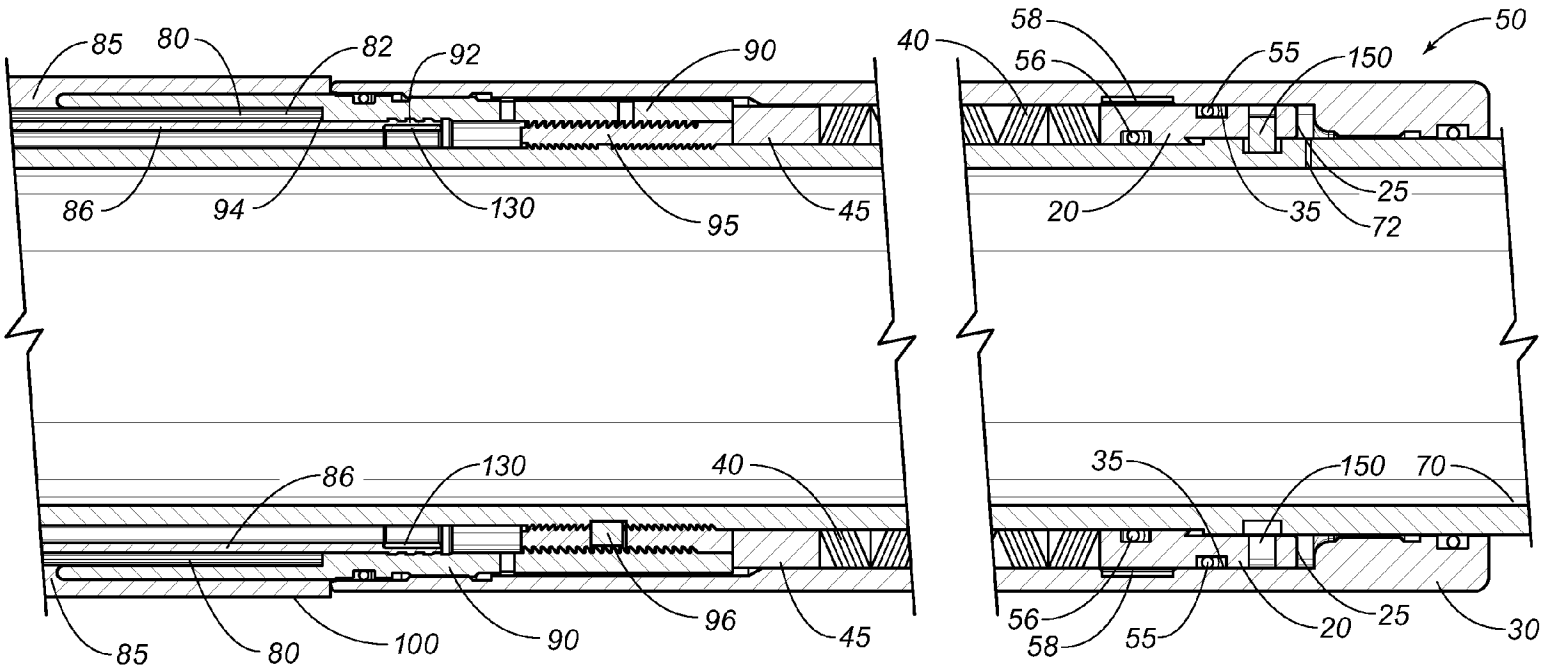
FIG. 4 depicts an enlarged view of the pre-activation embodiment depicted in FIG. 3A.
Figure 5:
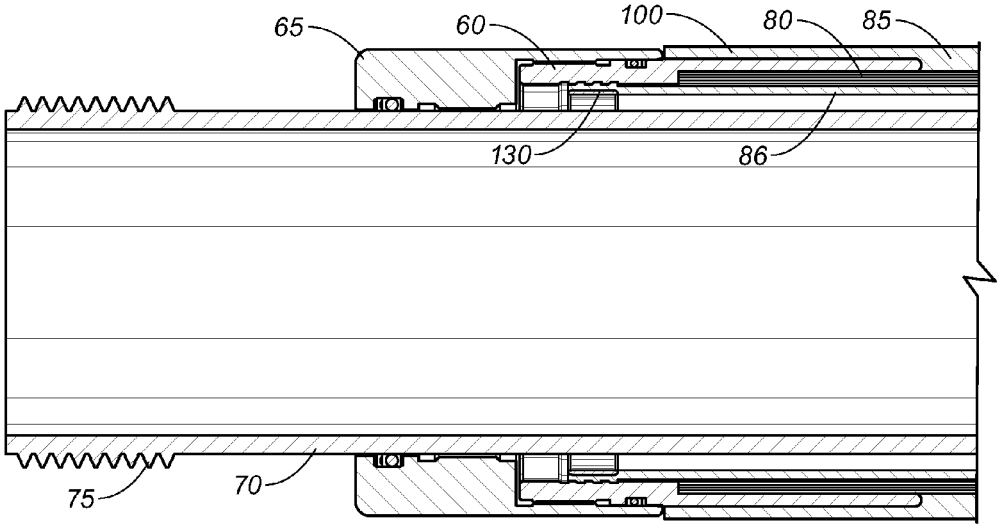
FIG. 5 depicts an enlarged view of the opposite end of the embodiment depicted in FIG. 4.

Thus, it will be seen that FIG. 3A depicts plurality of Belleville metal ring washer members 40 disposed in original natural convex configuration, while FIG. 3B depicts the plurality of Belleville metal ring washer members disposed in a compressed planar, parallel configuration due to being compressed attributable to sufficient activation fluid pressure. As hereinbefore elucidated, for the series of Belleville ring washer members to be disposed in the configuration illustrated in FIG. 3B from the configuration in FIG. 3A, retainer member 20 would have been urged to move toward these Belleville ring members, thereby causing spring-like compression thereof.

Situated just prior to plurality of shearing screws 150 there is seen a first O-ring 55 disposed upon outside diameter of retainer member 20, for sealing flow between the retainer and sealing sleeve 30. A second O-ring 56 is disposed upon inside diameter of retainer member 20. It will be appreciated that, after sufficient fluid pressure has been achieved to exceed a first predetermined threshold pressure causing plurality of shearing screws 150 to be ruptured and sufficient additional activation fluid pressure has been applied against retainer member 20—to exceed a second predetermined activation pressure threshold—to cause sliding movement thereof against the series of Belleville metal ring washer members 40, these washer ring members are compressed into a parallel and planar configuration. Simultaneously, sufficient activation fluid pressure is manifest against the retainer profile 25 wherein activation fluid can travel around displaced O-ring 55 and into recess 58 and then inside the inflatable packer embodiment 10 as contemplated hereunder. It will also be appreciated that the inflating rubber member 100 causes the plurality of metal rib members 80 to be deformed, since activation fluid accumulates under the rubber sleeve member 86 and wrapped rubber sleeve member 85, jointly sandwiching the plurality of metal rib members, causing inflation of adjacent exterior rubber sleeve member 100 that contains the continuous or discontinuous metal ribs 80 within rib housing 60 enclosed by rib housing cap 88 as shown and also enclosed by lock-ring housing 90, and welded thereto as herein described. Thus, as shown, each metal rib member is sandwiched between rubber sleeve member 85 on the outside thereof and rubber sleeve member 86 on the inside.

It should be understood by those skilled in the art, that, once sufficient activation fluid pressure has effectuated sufficient packer inflation wherein both activation pressure thresholds have been reached—with its contemplated downhole ramifications—the pressure should preferably be released and the retainer 20 consequently slidably returned to its initial position and, likewise, the series of Belleville metal ring washer members 40 being returned to a decompressed, natural convex configuration.

As shown, plurality of metal rib members 80 are preferably installed against lock-ring housing 90 and sandwiched laterally between two preferably rubber layers. More particularly, the metal rib members 80 are disposed beneath lock-ring housing 90 and above rubber sleeve member 86. As shown, for instance, rib members 80 should preferably be welded at corresponding straight end 82 thereof to lock-ring housing 90 at the vertical surface 92 thereof. And a similar situation pertains to rib housing too. The opposite curved end 84 of the metal rib members 80 should be uninhibited in order to manifest maximum inflation toward middle portion of the rubber sleeve member 100 engulfing the preferred embodiment hereof 10. That is, the preferably sandwiched rib members should preferably be fixed at one end where welded, but uninhibited from being deformed—akin to spokes of an umbrella disposed in open position—at the other end, when inflation has been activated as herein described.

It will be appreciated by those skilled in the art that plurality of metal rib members 80 may be disposed as two discontinuous portions upon lock-ring housing 90 or as one continuous portion affixed thereto. For the configuration in which the metal rib members comprise two discontinuous portions, it has been found to be advantageous for each such portion to traverse about ⅓ of the distance from each end thereof. As shown, this configuration enables each metal rib member portion to achieve maximum uninhibited expansion—analogous to two open umbrellas—manifest as corresponding maximum possible inflation of the preferred embodiment hereof 10. Similarly, for the configuration in which the metal rib members comprise one continuous portion, it has been found to be advantageous for this single metal rib member to extend the full length of the distance from one end to the other of the lock-ring housing 90—analogous to an open umbrella—manifest as corresponding maximum possible inflation of the preferred embodiment hereof 10. It has been found to be advantageous that full continuous rib members should be unwelded while extending from the lock-ring housing 90 to the rib housing 60. It will be appreciated by those skilled in the art that the lock-ring housing and rib housing should preferably be adjusted, e.g., size, geometric constraints, model selection, and the like to accommodate such continuous rib members. As shown, this configuration enables each metal rib member portion to achieve maximum uninhibited expansion manifest as corresponding maximum possible inflation of the preferred embodiment hereof 10.

Figure 6:
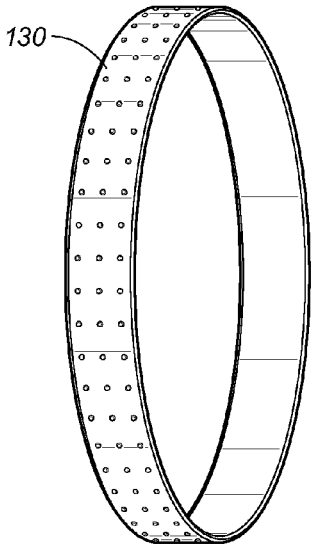
FIG. 6 depicts an isolated frontal perspective view of the enlargement nipple ring embodying the present invention.
Figure 7:
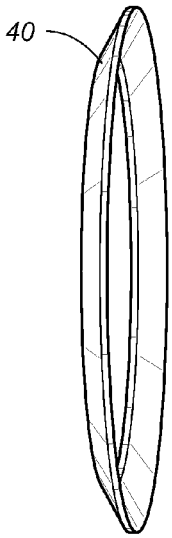
FIG. 7 depicts a frontal perspective view of a metal ring washer embodying the present invention.

Still referring to the collection of FIGS. 1-7 and focusing upon FIG. 6, enlargement nipple ring member 130, preferably constructed from an expandable metal, is attached to metal sealing sleeve member 30 in an already-expanded condition and stretches the adjoining sealing sleeve member 30—which simultaneously bites thereinto. That is, as will be readily appreciated by those skilled in the art, it has been found to be advantageous to size the outer diameter of the enlargement nipple ring 130 to be larger than the corresponding outer diameter of the sealing sleeve member 30 to which it is attached, wherein expansion of the enlargement nipple ring 130 is effectuated to such an extent that its larger size outer diameter causes the sealing sleeve member 30 to manifest expansion in excess of its outer diameter. It should be understood that this extreme sealing sleeve expansion urges the rubber sleeve 100 to expand or inflate like a balloon against lock-ring housing 90 until it reaches the inside wellbore wall. Once this full expansion has been achieved and the instant inflatable packer has achieved the contemplated production zone isolation or comparable objective as taught hereunder, then the activation pressure is released. Expansion of enlargement nipple ring 130 causes rubber sleeve member 100 to bite into the profile on the inside diameter of lock-ring housing 90, at the top of the instant embodiment and of the rib housing 60, at the bottom side thereof, and to fill this profile. As will be appreciated by those skilled in the art, filling this profile with rubber sleeve member 100 under the influence of enlargement nipple ring 130 prevents the activation fluid from being misdirected, but assures that the activation fluid proceeds directly beneath the sealing sleeve member 30 where activation fluid will accumulate, thereby causing rubber sleeve member 100 to inflate. It should be understood that, if the enlargement nipple ring 130 is not used, then activation fluid would be able to penetrate between the plurality of ribs and then fail to inflate the instant inflatable packer as contemplated hereunder. Thus, to achieve inflation as contemplated hereunder, activation fluid must accumulate under the rubber sleeve member 100.

It will be seen that metal sealing sleeve member 30 traps activation fluid from entering plurality of metal rib members 80. Thus, this preferred configuration inherent in embodiments hereof prevents activation fluid from entering the instant inflatable packer and from communicating with outside the activation assembly as herein described. This thoroughly insulating plurality of metal rib members preferably sandwiched between rubber layers, with wrapped rubber layer atop the metal rib members and the rubber sandwich configuration disposed below the metal rib members, effectively isolates the activation fluid disposed within preferred embodiments hereof.

Once the retainer 20 has been enabled and urged to move leftward toward plurality of spring-like members 40, after sufficient fluid pressure has caused the plurality of shearing screws 150 to be sheared, causing the Belleville washer ring members 40 to be simultaneously compressed, activation fluid flow commences around compensator member 45, sealing sleeve member 30, mandrel member 70, and lock-ring housing member 90—proceeding from right to left within the instant inflatable packer embodiment.

The following tabulation enumerates and identifies the various components comprising embodiments of the present invention.

Inflatable Packer Components

| Numeral | Description | Comments & Explanation |
|---|---|---|
| 10 | Inflatable packer | |
| 20 | Retainer member | Slides upon mandrel; pushes to left on series of Belleville washers causing (spring-like) compression thereof |
| 25 | Retainer profile | Vertical edge of retainer where activation fluid acts upon as pressure to push retainer away from mandrel communication port, in order to shear the shearing screws and then compress the Belleville washers |

-continued

Inflatable Packer Components

| Numeral | Description | Comments & Explanation |
|---|---|---|
| 30 | Sealing sleeve member | Metal; threadedly mates with mandrel; never moves; threadedly attached to lock-ring housing and O-ring assures integrity of seal |
| 35 | Surface of sealing sleeve | |
| 40 | Belleville washer ring members | |
| 45 | Compensator | Full disk shape; distributes activation pressure from compressed series of Belleville washers and transfers to lock-in-place ring and lock ring housing |
| 50 | Activation assembly | |
| 55 | O-ring | On OD - sealing against sealing sleeve |
| 56 | O-ring | On ID - sealing against mandrel |
| 58 | Recess for accommodating fluid flow | Accessible when Belleville washers compressed and O-ring in open position |
| 60 | Rib housing | |
| 65 | Rib housing cap | |
| 70 | Mandrel | Gray |
| 72 | Plurality of transverse channels | Cut through mandrel wall |
| 75 | Threads | |
| 80 | Metal rib member | Preferably sandwiched between rubber layers; installed against lock-ring housing, with short, vertical side welded; deforms under pressure; below ribs is rubber sleeve and above ribs is lock-in-place housing |
| 82 | Rib straight end | Welded to lock-ring housing |
| 84 | Rib curved free end | Umbrella-like deformation under fluid pressure |
| 85 | Wrapped rubber sleeve member | |
| 86 | Rubber sleeve member | |
| 88 | Rib Housing Cap | |
| 90 | Lock Ring Housing | threadedly mated to mandrel which prevents translation; has both O.D. thread and I.D. thread |
| 92 | Portion of Lock-Ring Housing | Adjacent Enlargement Nipple Ring |
| 94 | Vertical portion of Lock-Ring Housing | Rib member welded thereto |
| 95 | Lock-In-Place Ring | Not full disk configuration; emplaced upon mandrel and can be rotated thereon; once situated upon mandrel, profile keeps biting into mandrel external surface |
| 96 | Lock-In-Place Pin | Secured into mandrel and prevents rotation |
| 100 | Wrapping Rubber outer sleeve layer | Cured |
| 130 | Enlargement nipple ring | Already expanded when emplaced in situ; not attached to mandrel, but attached to metal sealing sleeve; has diameter larger than metal sealing sleeve and thus pushes sealing sleeve against lock-ring housing |
| 135 | Plurality of holes | Upon circumference of enlargement ring |
| 150 | Shearing screws | |
| 200 | Bridge Boot | Cured Rubber connecting the 2 Rubber Sleeves |

Other variations and modifications will, of course, become apparent from a consideration of the structures and techniques hereinbefore described and depicted. Accordingly, it should be clearly understood that the present invention is not intended to be limited by the particular features and structures hereinbefore described and depicted in the accompanying drawings, but that the present invention is to be measured by the scope of the appended claims herein.

What is claimed is:

1. A downhole permanent inflatable packer comprising:

an axially disposed cylindrical mandrel frictionally wrapped by an elastomeric sleeve member and having a plurality of concentric and coplanar transverse channel members cut through the wall thereof, and having a customer-specified threaded connection at one end thereof for connecting a tubular or a downhole tool therewith;

a cup tool for communicating high pressure activation fluid from a wellbore into an activation assembly affixed to the outer surface of said mandrel for controlling inflation of said downhole permanent inflatable packer;

said activation assembly enclosed within a sealing sleeve member and comprising:

a retainer member slidably mounted upon said mandrel;

a plurality of spring-like ring washer members affixed to said mandrel and disposed between said retainer member and a compensator member;

a lock-ring housing disposed at one end portion of said mandrel and adjacent said compensator member;

said lock-ring housing enclosing a lock-in-place ring member and at least one associated lock-in-place pin having a tooth-like profile for biting into the outer layer of said mandrel and becoming affixed thereto, for preventing rotational movement thereof relative to said mandrel;

an enlargement nipple ring disposed at an end portion of said elastomeric sleeve member and attached thereto, and adjacent said lock-ring housing;

a rib housing affixed to said mandrel and disposed at another end portion thereof, diametrically opposite of said lock-ring housing; and a dual safety assembly for preventing premature activation of said plurality of spring-like ring washer members until a first threshold activation fluid pressure is reached to initiate sliding movement of said retainer member against at least one shearing screw member contained within said retainer member and screwably affixed to said mandrel, and then a second threshold activation fluid pressure, greater than said first threshold activation pressure, is reached to slidably impress said retainer member against said plurality of spring-like ring washer members causing compression thereof.

2. The downhole permanent inflatable packer recited in claim 1, wherein a plurality of rib members is frictionally sandwiched between elastomeric layers, and enclosed within and affixed to said lock-ring housing and said rib housing; and wherein each of said plurality of rib members is disposed beneath said lock-ring housing and above said elastomeric sleeve member.

3. The downhole permanent inflatable packer recited in claim 2, wherein each of said plurality of rib members further comprises a straight end and an opposite arched end, with said straight end fixedly attached to either a vertical surface of said lock-ring housing or a vertical surface of said rib housing, with each of the opposite ends thereof, respectively, being uninhibited wherein each corresponding free end thereof may be inflated severalfold causing proportional inflation of said elastomeric sleeve member.

4. The downhole permanent inflatable packer recited in claim 1, wherein said activation assembly comprises a first O-ring member sealed against said sealing sleeve member at its proximal vertical surface and affixed within an adjacent groove member disposed circumferentially of said retainer member when said retainer member is disposed in its initial pre-activation position.

5. The downhole permanent inflatable packer recited in claim 4, wherein said retainer member of said activation assembly is caused to slidably contact and rupture said at least one shearing screw member and then to slidably impress against said plurality of spring-like ring washer members, in turn, causing said first O-ring member to simultaneously move along with said retainer member, thereby enabling said activation fluid to flow around said first O-ring member and consequently enter a recess member disposed between said sealing sleeve member and said mandrel.

6. The downhole permanent inflatable packer recited in claim 5, wherein said compression of said plurality of spring-like ring washer members urges said first O-ring member to move proximal to said recess member wherein said activation fluid is enabled to flow therearound and into said recess member surface disposed between said sealing sleeve member and said mandrel, with said activation fluid accumulating therein to cause inflation of said elastomeric member and, in turn, causing said rubber-sleeved sandwiched plurality of metal rib members to be irreversibly deformed.

7. The downhole permanent inflatable packer recited in claim 6, wherein said activation fluid accumulates within said recess member causing said elastomeric sleeve member to inflate and said rubber-sleeved sandwiched plurality of rib members to be inflated severalfold into an irreversibly deformed configuration.

8. The downhole permanent inflatable packer recited in claim 7, wherein said elastomeric sleeve member prevents activation fluid from entering said plurality of rib members, thereby, in turn, negating fluid communication between inside said activation assembly and said wellbore.

9. The downhole permanent inflatable packer recited in claim 5, wherein said lock-in-place ring is configured to be less than a full circle, in the range 325° to 359°, to enable positioning thereof upon said mandrel outer surface prior to being affixed thereto.

10. The downhole permanent inflatable packer recited in claim 5, wherein said compensator distributes fluid pressure engendered from said plurality of spring-like ring washer members between said lock-in-place ring member and said lock-ring housing.

11. The downhole permanent inflatable packer recited in claim 5, wherein said enlargement nipple ring member is configured with a larger diameter than the diameter of said rubber sleeve, thereby urging severalfold expansion of said rubber sleeve until reaching full expansion thereof and the wellbore walls are contacted.

* * * * *